US005472586A

United States Patent [19]

Ishibashi et al.

[11] Patent Number: 5,472,586

[45] Date of Patent: Dec. 5, 1995

[54] APPARATUS AND METHOD FOR PURIFYING BATH LIQUIDS

[75] Inventors: Tadaya Ishibashi, Suita; Hideto Obara; Satoshi Taue, both of Uji, all of Japan

[73] Assignee: Unitika, Ltd., Japan

[21] Appl. No.: 288,579

[22] Filed: Aug. 10, 1994

[30] Foreign Application Priority Data

Aug. 27, 1993 [JP] Japan ..... 5-212021

[51] Int. Cl.[6] ..... B01D 61/44

[52] U.S. Cl. ..... 204/182.4; 204/180.8; 204/301; 204/252; 204/263

[58] Field of Search ..... 204/182.4, 96, 204/301, 252, 263, 180.8

[56] References Cited

U.S. PATENT DOCUMENTS

| | | | |
|---|---|---|---|
| 3,869,359 | 3/1975 | Beer | 204/96 |
| 4,128,465 | 12/1978 | Smith | 204/182.4 |

FOREIGN PATENT DOCUMENTS

| | | |
|---|---|---|
| WO/A8605523 | 9/1986 | European Pat. Off. . |
| 0507006A1 | 10/1992 | European Pat. Off. . |
| WO/93062661 | 4/1993 | European Pat. Off. . |
| 0585207 | 3/1994 | European Pat. Off. . |
| 2314900 | 1/1977 | France . |
| 4-304393 | 10/1992 | Japan . |
| 2-45489 | 10/1992 | Japan . |
| 4-354890 | 12/1992 | Japan . |

*Primary Examiner*—John Niebling
*Assistant Examiner*—Arun S. Phasge
*Attorney, Agent, or Firm*—Barnes, Kisselle, Raisch, Choate, Whittemore & Hulbert

[57] ABSTRACT

An apparatus and method for purifying metal ion-containing bath liquids used for metal surface cleaning. The method comprises circulating two kinds of bath liquids (11A, 11B) through a plurality of electrolytic cells (1), each composed of an anode (2) and a cathode (4) separated by two ion-selective permeable diaphragms (6, 7), in such a way as to introduce the bath liquid into the intermediate compartment (8), electrophoresing metal ions contained in the bath liquids (11A, 11B ) into the cathode compartment (5) of each electrolytic cell (1), simultaneously circulating the catholyte (14) through the cathode compartment (5) of the electrolytic cell (1), thereby forming and coagulating easily magnetizable metal particles and hardly magnetizable metal particles in the catholyte (14), and separating the coagulation using a magnetic separator (17).

5 Claims, 3 Drawing Sheets

APPARATUS AND METHOD FOR PURIFYING BATH LIQUIDS

FIELD OF THE INVENTION

The present invention relates to an apparatus and method for purifying bath liquids used for metal surface cleaning by separation of dissolved metal cations therefrom.

BACKGROUND OF THE INVENTION

The present inventors had disclosed in Japanese Patent Laid-open Nos. 304393/1992 and 354890/1992 a method for purifying a bath liquid by electrolysis. This method employs an electrolytic cell provided with an ion-selective diaphragm between the anode and cathodes. According to this method, a bath liquid used for metal surface cleaning is supplied to the compartment between the anode and diaphragm (referred to as the anode compartment hereinafter). The bath liquid undergoes electrolysis such that metal cations contained therein migrate toward the cathode through the diaphragm by electrophoresis. Thus, metal cations are separated and collected in the cathode compartment, and finally they are removed by some means. This method would be of great industrial use if the catholyte to be circulated through the cathode compartment is controlled such that separated metal ions are converted into an easy-to-use form.

In contrast to the foregoing method, the present inventors propose a method for disposing of waste which occurs when a bath liquid used for metal surface cleaning is treated, instead of direct discharging, to avoid environmental pollution. This method employs an electrolytic cell provided with one or two ion-selective permeable diaphragms between the anode and cathode. According to this method, a used bath liquid is recycled to the anode compartment or the intermediate compartment between the diaphragms. It undergoes electrolysis such that metal ions migrate toward the cathode compartment through the permeable diaphragm by electrophoresis. The metal ions are changed into metal particles in the cathode compartment. Finally, the metal particles are removed by a magnetic separator, according to the present invention. This method offers the advantage of not only reducing the contaminant in the bath liquid but also recycling the metal component from the bath liquid.

The above-mentioned method for purifying a bath liquid suffers the disadvantage that the metal particles formed in the catholyte cannot be removed by a magnetic separator unless they are easily magnetized. For example, divalent ($Fe^{+2}$) iron ions contained in a bath liquid gives rise to metal particles, such as triiron tetraoxide, which are easily magnetized and removed by a magnetic separator. By contrast, trivalent aluminum or chromium ions in a bath liquid do not give rise to metal particles which are easily magnetized

DISCLOSURE OF THE INVENTION

The present invention was completed to address the abovementioned problems involved in the prior art. It is an object of the present invention to provide an apparatus and method for purifying bath liquids of contaminants which do not form in the catholyte metal particles which are easily magnetized in themselves.

According to the present invention, the apparatus for purifying bath liquids comprises a plurality of reservoirs holding bath liquids containing metal ions, a plurality of electrolytic cells, each having a cathode and an anode separated by one or more ion-selective permeable diaphragms, a plurality of passages for circulation of the bath liquids through the bath liquid reservoir and the anode compartment or the intermediate compartment between the diaphragms, a catholyte reservoir in which is stored and mixed the catholyte to be circulated through the cathode compartment of the electrolytic cells, and a magnetic separator to separate metal particles which have formed in the catholyte.

This apparatus is operated such that at least one of the bath liquid reservoir holds a bath liquid containing divalent ($Fe^{+2}$) iron ions and this bath liquid is circulated through the intermediate compartment of the electrolytic cell. The divalent ($Fe^{+2}$) iron ions migrate from the intermediate compartment to the cathode compartment through the diaphragm by electrophoresis. In the cathode compartment, the migrated divalent ($Fe^{+2}$) iron ions change into particles of composite oxide composed of iron oxide (as the nucleus) and other metal oxides resulting from migrated divalent metal ions. These particles are easily magnetized. The composite oxide is a magnetite compound which is schematically represented by MeO-Fe3O2 (M=divalent metal ion species). Its typical example is FeO-Fe3O2 (Me=Fe), triiron tetraoxide. The composite oxide particles form when the liquid in the cathode compartment has a specific composition and is mixed with hydrogen (in the form of fine bubbles) which is evolved from the electrode surface. The reaction under this condition dehydrates the resulting compound. This method differs from the known method of oxidation by air blowing. The above-mentioned reaction needs high alkalinity, high temperatures, and thorough mixing of solution with hydrogen for dehydration from the compound.

According to the first aspect of the present invention, the method for purifying bath liquids comprises circulating metal ion-containing bath liquids (of different kind) used for metal surface cleaning through a plurality of electrolytic cells, each composed of an anode and a cathode separated by one or more ion-selective permeable diaphragms in such a way as to introduce the bath liquid into the anode compartment or the intermediate compartment between the diaphragms, electrophoresing metal ions contained in the bath liquid into the cathode compartment through the permeable diaphragm, simultaneously circulating the catholyte into the cathode compartment, thereby forming and coagulating easily magnetizable metal particles and hardly magnetizable metal particles in the catholyte, and separating the coagulation using a magnetic separator. According to a preferred embodiment, least one of the bath liquids contains divalent ($Fe^{+2}$) iron ions and this bath liquid is circulated through the intermediate compartment through the bath liquid passage.

According to the second aspect of the present invention, the method for purifying a bath liquid comprises circulating a metal ion-containing bath liquid used for metal surface cleaning through an electrolytic cell composed of an anode and a cathode separated by one or two ion-selective permeable diaphragms in such a way as to introduce the bath liquid into the anode compartment or the intermediate compartment between the diaphragms, electrophoresing metal ions contained in the bath liquid into the cathode compartment through the permeable diaphragm, simultaneously circulating through the cathode compartment the catholyte into which easily magnetizable metal particles have been introduced, thereby coagulating easily magnetizable metal particles together with hardly magnetizable metal particles which have been electrophoresed into the cathode compartment, and separating the coagulation using a magnetic separator.

By using the above-mentioned apparatus for purifying bath liquids, it is possible to form easily magnetizable metal particles and hardly magnetizable metal particles in the catholyte or to introduce easily magnetizable metal particles into the catholyte. The metal particles coagulate in the catholyte, and the coagulation can be removed using a magnetic separator. Thus the apparatus makes it possible to easily separate metal particles which cannot be magnetically separated in themselves.

According to the present invention, easily magnetizable metal particles and hardly magnetizable metal particles are formed in the catholyte or the former is introduced into the catholyte, so that they coagulate in the catholyte and the coagulation is removed by a magnetic separator. Thus the present invention permits one to easily separate those contaminants which are hard to separate by the conventional technology because they are hardly magnetized in themselves.

DESCRIPTION OF THE PREFERRED EMBODIMENTS

An embodiment of the present invention will be described with reference to the drawings.

Figure 1:
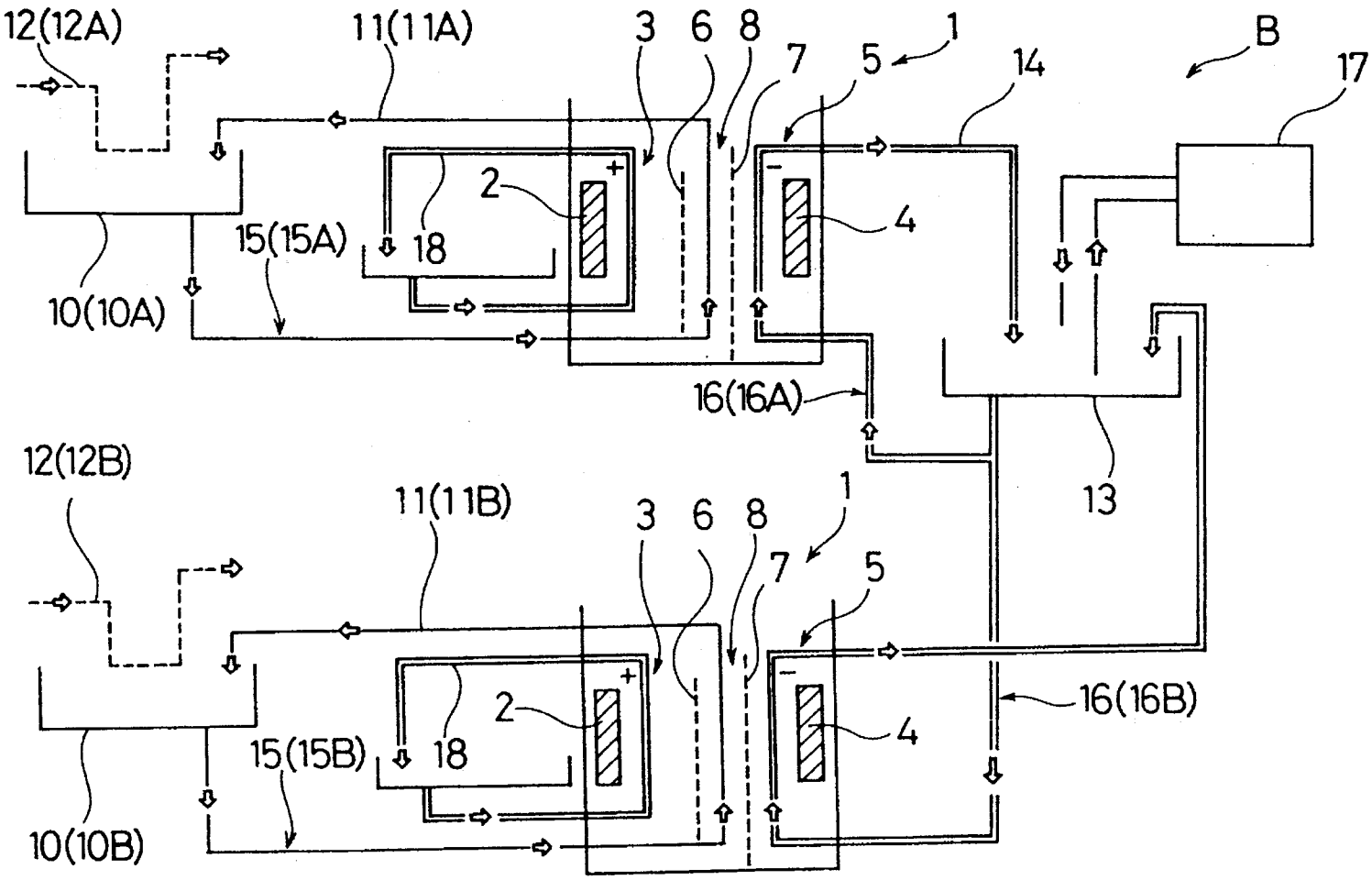
FIG. 1 is a schematic drawing showing the bath liquid purifying apparatus pertaining to an embodiment of the present invention.
Figure 2:
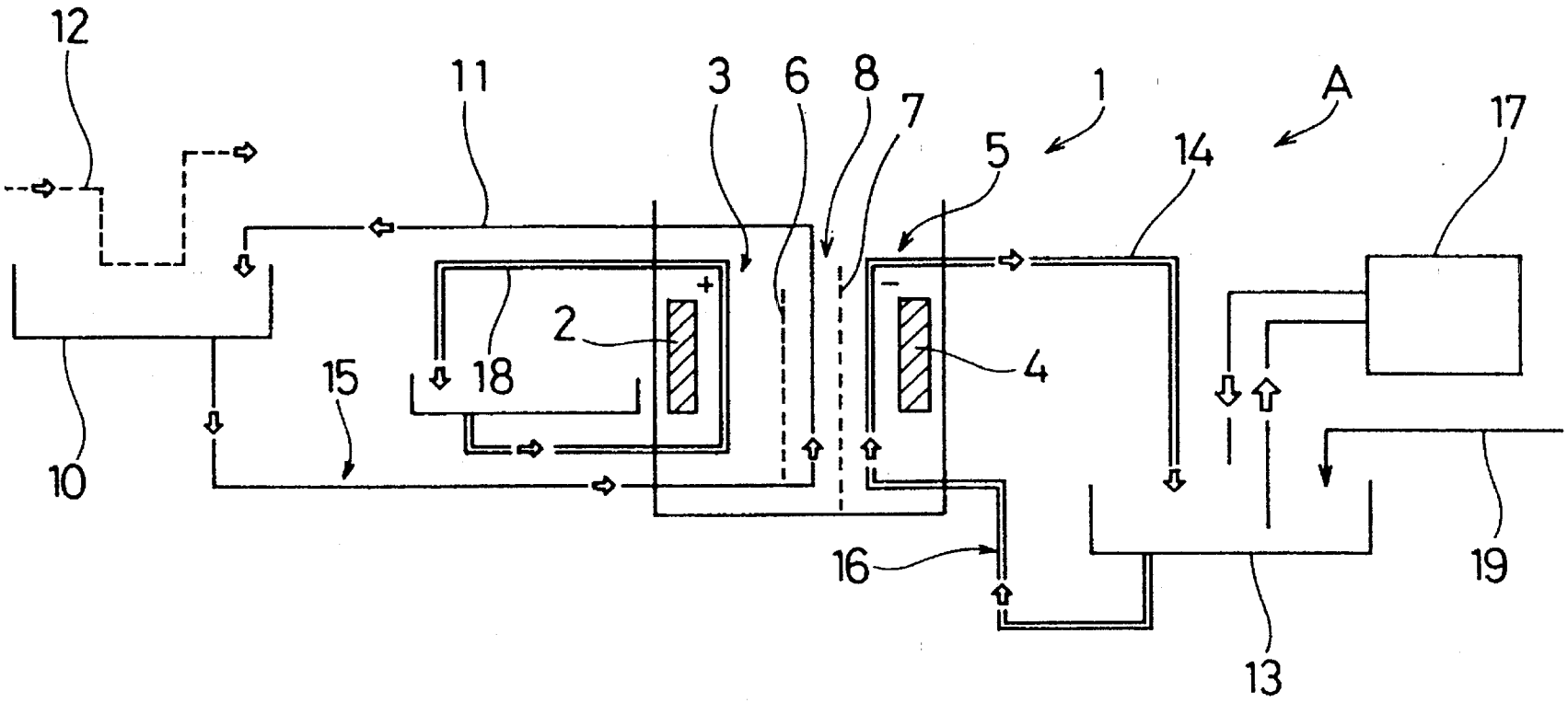
FIG. 2 is a schematic drawing showing the bath liquid purifying apparatus pertaining to another embodiment of the present invention.

The apparatus pertaining to the present invention is shown in FIGS. 1 and 2. The one (system A) in FIG. 2 is composed of a single electrolytic cell (1). The one (system B) in FIG. 1 is composed of two units of the same electrolytic cell as in system A. The structure of the electrolytic cell (1) is explained below.

The electrolytic cell (1) is of so-called three-compartment type. That is, it is constructed of an anode compartment (3) provided with an anode (2) and a cathode compartment (5) provided with a cathode (4), with said compartments being separated by two diaphragms (6, 7). In other words, the anode (2) and cathode (4) face each other with the two diaphragms (6, 7) placed between. The two diaphragms (6, 7) constitute an intermediate compartment (8) between them.

The anode (2) and cathode (4) are a flat plate measuring 220 mm wide, 660 mm long, and 14.5 $dm^2$ in area. The cathode (4) is a 1.5-mm thick titanium plate of lath structure. The anode (2) is made of either of the following two materials. (a) A platinum foil-clad titanium plate of lath structure. (b) A titanium plate of lath structure with melt coating of iridium oxide (Ir-O). Both anodes are uniformly supplied with electricity.

The lath structure is intended to increase the apparent area of the electrode plate by perforating it and stretching to form a rhombic pattern. If a 1.5-mm thick plate is given cuts at intervals of 2 mm and stretched in the direction perpendicular to the direction of cuts so as to form a rhombic pattern, each rhombus measuring 3.3 mm wide and 6.8 mm long, the resulting electrode has a surface area which is about 1.65 times that of the original (unexpanded) plate. The increased apparent surface area lowers the ratio of the substantially effective area to the apparent area, and this leads to an increase of load current density. This effect is significant in the case of the platinum-clad anode (2), in which the effective area is 2 mm wide. However, this effect is not so significant in the case of the cathode (4), in which the surface formed by cuts also conducts electricity.

Between the anode (2) and the cathode (4) are placed the diaphragms (6, 7), which are a cation exchange membrane having good chemical resistance, low electrical resistance, and cation selective permeability. Between the two electrodes (2, 4) in the electrolytic cell (1) is applied an electric current of 0.5–60 $A/dm^2$ at a controlled voltage. The anode and cathode compartments (3, 5) are each supplied with a solution at a rate of 1.5–4 $m^3/h$ and a flow rate of 0.04–0.2 m/s, so that the gas that is evolved on the electrode surface is efficiently discharged. In this way the electrode surface is protected from sticking and accumulation of substances which have separated from the electrolyte.

In each of FIGS. 1 and 2, there is shown a reservoir for acid bath liquid (10 (10A, 10B)) which holds the acid bath liquid (11 (11A, 11B)) to be electrolyzed, a steel stock (12 (12A, 12B)) to be cleaned by the acid bath liquid (11), and a catholyte reservoir (13) which holds the catholyte (14) to be supplied to both electrolytic cells. The acid bath liquid (11) to be electrolyzed is circulated through the reservoir (10) and the intermediate compartment (8) of the electrolytic cell (1) via the acid bath liquid passage (15 (15A, 15B). The catholyte (14) is circulated through the catholyte reservoir (13) and the cathode compartment (5) of the electrolytic cell (1) via the catholyte passage (16 (16A, 16B). Part of the catholyte (14) is pumped from the catholyte reservoir (13) and circulated through the separating tank in which is installed a magnetic separator (17).

The anode compartment (3) is supplied with the circulating electrolyte (18) for protection of the anode (2). By circulating the acid bath liquid (11) into the intermediate compartment (8), the acid bath liquid (11) does not contact the anode (2), causing no damage to the anode (2) and no change to the soluble substance. In other words, if the acid bath liquid (11) directly contacts the anode (2), oxygen gas is caused to generate from the contact surface of the anode (2), whereby the soluble substance of the acid bath (11) changes and the active electrons of the acid bath liquid (11) contact the anode (2), thereby causing the soluble substance of the acid bath liquid (11) to degrade.

The intermediate compartment (8) is constituted by a metal frame which supports the diaphragms (6, 7) 8 mm apart, with a rubber gasket interposed between each diaphragm and the metal frame. It is desirable to place in the intermediate compartment (8) a baffle which makes the flow therein uniform (thereby decreasing the pressure loss) and prevents the diaphragms (6, 7) from coming into contact with each other.

The composition of the catholyte (14) is such that the material electrophoresed into the cathode compartment (5) is hydrophobic enough to give rise to particles which readily precipitate. For example, the catholyte (14) is incorporated with Glauber's salt (ca. 120–150 g/l) to impart conductivity and urea as a source of ammonium ions. Urea gives rise to ammonium ions upon decomposition at high temperatures on the surface of the cathode (4). The amount of urea is controlled such that the concentration of residual ammonium ions is 0.2–1,500 mg/l. The temperature of the electrolyte is kept higher than 60° C. Electrolysis should be carried out such that the concentration of insoluble matters electrophoresed into the catholyte (14) is almost constant below about 1500 g/l, because at such concentrations the separated insoluble matters easily grow in particle size.

In an experiment with system A which employs a single electrolyte (1) as shown in FIG. 2, an acid bath liquid (11), which is sulfuric acid containing 50 g/l of divalent ($Fe^{+2}$) iron ions, was circulated through the intermediate compartment (8) of the electrolytic cell (1) while the catholyte (14) of the abovementioned composition was circulated. As the result of electrophoretic separation, a highly magnetic dispersion of triiron tetraoxide formed in the catholyte (14). The dispersion was capable of separation by the magnetic separator (17). There were no magnetizable particles suspending in the supernatant liquid left after separation. Thus the catholyte (17) was recovered clear and the particles were separated by attraction to the magnet.

Another experiment with system A shown in FIG. 2 was performed on an acid bath liquid (11) containing free phosphoric acid (in a large amount), hydrofluoric acid (in a slight amount), trivalent aluminum ions (200 mg/l), and trivalent chromium ions (500 mg/l). Aluminum and chromium ions are contaminants to be removed. The acid bath liquid (11) was circulated through the intermediate compartment (8) of the electrolytic cell (1) so that the metal cations are separated by electrophoresis into the cathode compartment (5). It was found that insoluble matter formed in the circulating catholyte (14). As the amount of the dispersion increased with time, the catholyte (14) was introduced into the separating tank to separate the dispersion. However, it was impossible to separate the dispersion using the magnetic separator (17), because the dispersion was not easily magnetized and was composed of such small particles as to adsorb water molecules.

An experiment was conducted with system B equipped with two units of the electrolyte (1) as shown in FIG. 1. An acid bath liquid (11A), which is sulfuric acid containing 50 g/l of divalent ($Fe^{+2}$) iron ions as the major component, was circulated through the intermediate compartment (8) of the first electrolytic cell (1). Simultaneously, another acid bath liquid (11B) containing free phosphoric acid (in a large amount), hydrofluoric acid (in a slight amount), trivalent aluminum ions (200 mg/l), and trivalent chromium ions (500 mg/l) was circulated through the intermediate compartment (8) of the second electrolytic cell (1). The catholyte (14) of the above-mentioned composition was circulated through the cathode compartment (5) of each of the two electrolytic cells (1). As electrolysis went on, a highly magnetic dispersion containing triiron tetraoxide formed in the circulating catholyte (14). This dispersion was free from particles which were not attracted by the electromagnet, in contrast to the case in which the electrolytic cell (1) was used alone to electrolyze the acid bath liquid (11). Thus, it was possible to separate the circulating liquid into the clear catholyte (14) and the substance attracted to the electromagnet. The latter consists of particles of triiron tetraoxide (which are easily magnetized) and particles of aluminum and chromium (which are hardly magnetized). Thus, this experiment demonstrated that these particles can be removed together by means of the magnetic separator (17).

A procedure was found to convert a nonmagnetic substance containing aluminum and chromium into a substance that can be easily separated from the catholyte (14). This procedure employs system A equipped with the single electrolytic cell (1) as shown in FIG. 2. The acid bath liquid (11) containing divalent ($Fe^{+2}$) iron ions as the major component undergoes electrophoresis to separate the magnetic substance (19) containing triiron tetraoxide. The magnetic substance (19) thus separated is introduced into the catholyte (14) when the acid bath liquid (11) containing aluminum and chromium as the major components undergoes electrophoresis. The mixing of the nonmagnetic separable substance with the magnetic separable substance gives rise to a mixture which is attracted to the magnetic separator (17). If some nonmagnetic particles remain unremoved, it is possible to remove them completely by introducing more of the magnetic separable substance (19) more into the catholyte (14). In the case where the amount of the nonmagnetic separable substance is small, it is possible to produce the same effect as above by dispersing the magnetic separable substance into the catholyte (14) once again.

The above-mentioned procedure demonstrates that if the dispersion that cannot be magnetically separated in itself is mixed with the magnetic separable substance (19), the resulting mixture can be magnetically separated.

Although the foregoing description deals with system B equipped with two units of the electrolytic cell (1) as shown in FIG. 1, the apparatus of the present invention may be made up of more than two units of the electrolytic cell (1) and the acid bath liquid reservoir (10), so long as it is constructed such that an easily magnetizable dispersion forms in at least one cathode compartment (5).

Figure 3:
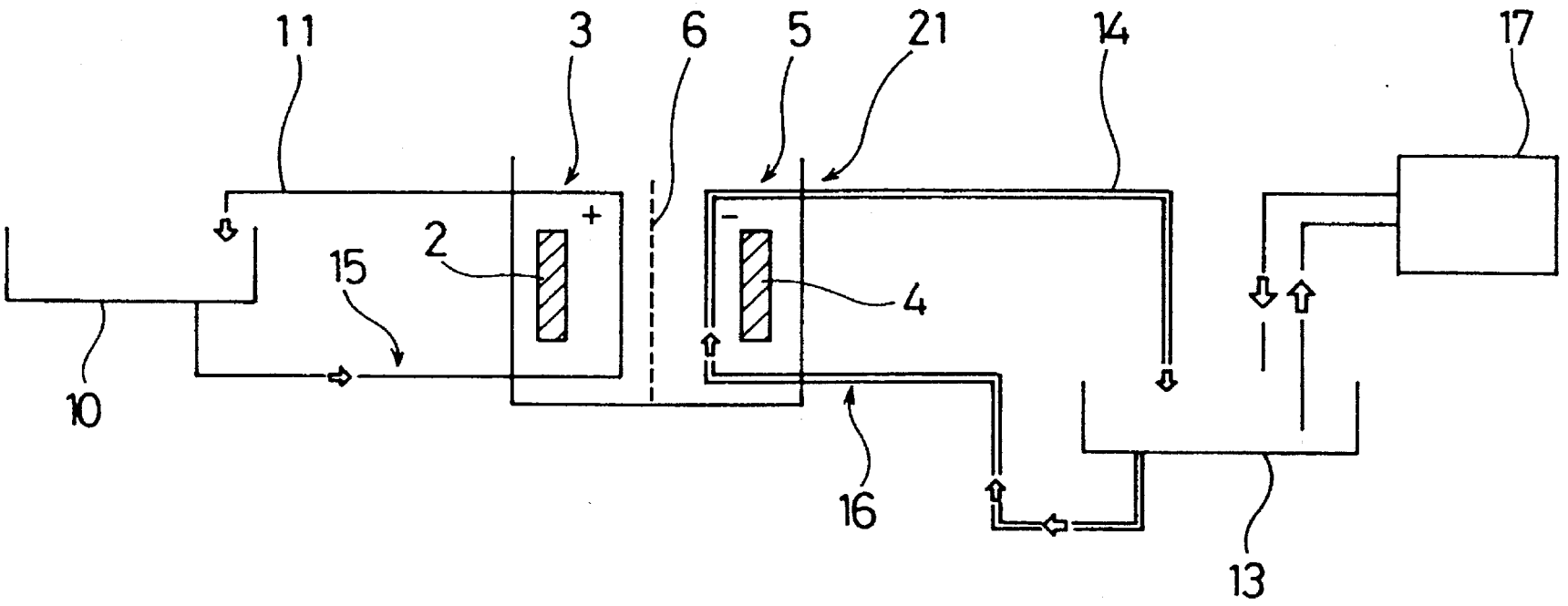
FIG. 3 is a schematic drawing showing the electrolytic cell of the bath liquid purifying apparatus pertaining to an embodiment of the present invention.

The above-mentioned embodiments employ the electrolytic cell (1) of so-called three-compartment type in which there are two diaphragms (6, 7). However, the number of the diaphragms may be increased or reduced, as in the case of the electrolytic cell (21) of so-called two-compartment type shown in FIG. 3. In this case, the acid bath liquid (11) is circulated through the anode compartment (3). The foregoing embodiments were mentioned with reference to the instance in which the acid bath liquid (11) contains divalent ($Fe^{+2}$) iron ions and triiron tetraoxide forms in the cathode compartment (5). The present invention is not limited to them so long as it is so constituted that an easily magnetizable dispersion is formed from any other acid bath liquid.

What is claimed is:

1. An apparatus for purifying bath liquids of different kinds used for cleaning metal surfaces by separating metal cations dissolved in the bath liquids during cleaning of the metal surfaces, at least a portion of said metal cations being capable of forming magnetic metal particles, said apparatus comprising:

a plurality of reservoirs, each holding a bath liquid containing metal ions;

a plurality of electrolytic cells, each having a cathode compartment and an anode compartment separated by one or more ion-selective permeable diaphragms;

a plurality of passages, each for circulating the bath liquid through each of the bath liquid reservoirs and said anode compartment or an intermediate compartment defined between the diaphragms;

a catholyte reservoir for storing and mixing a catholyte to be circulated through each of said cathode compartments of the electrolytic cells, in order to cause metal particles contained in the catholyte to be formed by way of coagulating the magnetic metal particles and non-magnetic metal particles together; and a magnetic separator for separating the coagulated metal particles from the catholyte.

2. An apparatus for purifying bath liquids as defined in claim 1, wherein at least one bath liquid contains divalent iron ions ($Fe^{2+}$) and this bath liquid is circulated through the intermediate compartment of the electrolytic cell via the bath liquid passage.

3. A method for purifying bath liquids of different kinds used for cleaning metal surfaces by separating metal cations dissolved in the bath liquids, said method comprising:

circulating metal ion-containing bath liquids through a plurality of electrolytic cells, each composed of an anode compartment and a cathode compartment separated by one or more ion-selective permeable diaphragms, in such a way as to introduce the bath liquid into said anode compartment or an intermediate compartment defined between the diaphragms;

electrophoresing metal ions contained in the bath liquid into said cathode compartment through the permeable diaphragm;

circulating a common catholyte into each of said cathode compartments of the electrolytic cells, thereby forming metal particles in the catholyte by way of coagulating magnetic metal particles and non-magnetic metal particles together; and separating the coagulated metal particles from the catholyte by a magnetic separator.

4. A method for purifying bath liquids as defined in claim 3, wherein at least one bath liquid contains divalent iron ions ($Fe^{2+}$) and this bath liquid is circulated through the intermediate compartment of the electrolytic cell.

5. A method for purifying a bath liquid used for cleaning metal surfaces by separating metal cations dissolved in the bath liquid, said method comprising:

circulating a metal ion-containing bath liquid used for metal surface cleaning through an electrolytic cell comprising an anode compartment and a cathode compartment separated by one or more ion-selective permeable diaphragms, in such a way as to introduce the bath liquid into said anode compartment or an intermediate compartment defined between the diaphragms;

electrophoresing metal ions contained in the bath liquid into said cathode compartment through the permeable diaphragm;

circulating a catholyte through said cathode compartment in such a way as to introduce magnetic metal particles into the catholyte, thereby coagulating the magnetic metal particles together with the non-magnetic metal particles which have been electrophoresed into said cathode compartment; and separating the coagulated metal particles from the catholyte by a magnetic separator.

* * * * *